US006105994A

United States Patent [19]

Parris et al.

[11] Patent Number: 6,105,994

[45] **Date of Patent: *Aug. 22, 2000**

[54] STEP-IN BINDING HAVING SAFETY RELEASE MECHANISM FOR TELEMARK SKI

[76] Inventors: James E. Parris, 261 San Pedro Ave., Pacifica, Calif. 94044; Lance B. Levy, 840 Lombard St., San Francisco, Calif. 94133; Bob Jensen, 1383 Grand Ave., Pacifica, Calif. 94044

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,805

[22] Filed: Apr. 9, 1997

[51] Int. Cl.[7] ..... A63C 9/08

[52] U.S. Cl. ..... 280/614; 280/617; 280/632

[58] Field of Search ..... 280/615, 634, 280/618, 620, 619, 614, 632, 626, 631, 617

[56] References Cited

U.S. PATENT DOCUMENTS

| | | | |
|---|---|---|---|
| 3,989,273 | 11/1976 | Schmidt | 280/631 |
| 4,082,314 | 4/1978 | Sedlmair | 280/625 |
| 4,094,530 | 6/1978 | Sedlmair | 280/625 |
| 4,095,821 | 6/1978 | Salomon | 280/628 |
| 4,128,257 | 12/1978 | Zoor | 280/614 |
| 4,129,319 | 12/1978 | Strohmeier | 280/615 |
| 4,148,502 | 4/1979 | Staufer et al. | 280/615 |
| 4,219,217 | 8/1980 | Gertsch | 280/629 |
| 4,227,715 | 10/1980 | Kirchmeyr | 280/618 |
| 4,236,727 | 12/1980 | Storandt | 280/629 |
| 4,480,850 | 11/1984 | Schneider | 280/630 |
| 4,496,167 | 1/1985 | Krob et al. | 280/605 |
| 4,513,988 | 4/1985 | Svoboda | 280/615 |
| 4,563,021 | 1/1986 | Klubitschko | 280/612 |
| 4,635,955 | 1/1987 | Zoor | 280/614 |
| 4,647,064 | 3/1987 | Salomon et al. | 280/615 |
| 4,659,103 | 4/1987 | Tessaro | 280/615 |
| 4,674,766 | 6/1987 | Ramer | 280/614 |
| 4,691,936 | 9/1987 | Nowak et al. | 280/615 |
| 4,765,640 | 8/1988 | Jungkind | 280/615 |
| 4,792,156 | 12/1988 | Hue | 280/615 |
| 4,801,154 | 1/1989 | Dunand | 280/615 |
| 4,836,572 | 6/1989 | Pozzobon | 280/613 |
| 4,863,186 | 9/1989 | Rullier et al. | 280/626 |
| 4,909,532 | 3/1990 | Provence et al. | 280/615 |

(List continued on next page.)

OTHER PUBLICATIONS

Off Piste, The Backcountry Skiers Catalog, Winter 96/97.
Reliable Nordic, Sales Brochure, Winter 96/97.
Rossignol Ski Company, Inc., Sales Brochure, 1996.
Couloir, vol. IX, No. 3, p. 5, Jan./Feb. 1997.
Voilé, Backcountry Ski and Snowboard Equipment 97–98 Catalog, pp 12, 14, 18, 22 et seq.

*Primary Examiner*—Michael Mar
*Assistant Examiner*—Lynda Jasmin
*Attorney, Agent, or Firm*—Haverstock & Owens LLP

[57] ABSTRACT

A step-in binding for telemark ski having safety release mechanism. The binding comprises a mounting plate, a housing, a clamp lever and a step-in lever. Step-in securing is initiated by applying pressure to an step-in lever, which in turn causes a clamp lever to rotate downwardly towards to hold a ski boot in place. A latching means comprising a tooth and a catching post locks the clamp lever in an engaged position to securely hold the ski boot. A safety release mechanism is activated by rotating the housing assembly about an pivot post such that the tooth falls off the catching post, thus allowing the key to be lowered and opening the toe clamp to release the ski boot. The binding is automatically reset to a position for receiving the ski boot after the safety release mechanism is activated.

27 Claims, 17 Drawing Sheets

U.S. PATENT DOCUMENTS

| | | | |
|---|---|---|---|
| 4,913,455 | 4/1990 | Salsetti et al. | 280/615 |
| 4,915,406 | 4/1990 | Graillat | 280/615 |
| 4,917,399 | 4/1990 | Hölzl | 280/615 |
| 4,925,206 | 5/1990 | Graillat | 280/615 |
| 4,960,289 | 10/1990 | Stritzl et al. | 280/630 |
| 4,998,746 | 3/1991 | Arnulf | 280/615 |
| 5,015,005 | 5/1991 | Hornschemeyer et al. | 280/630 |
| 5,048,855 | 9/1991 | Girault et al. | 280/615 |
| 5,066,036 | 11/1991 | Broughton | 280/615 |
| 5,087,065 | 2/1992 | Provence et al. | 280/615 |
| 5,092,620 | 3/1992 | Girault et al. | 280/615 |
| 5,190,310 | 3/1993 | Haughlin et al. | 280/615 |
| 5,213,359 | 5/1993 | Girard | 280/615 |
| 5,249,820 | 10/1993 | Burger et al. | 280/614 |
| 5,265,901 | 11/1993 | Gorza | 280/632 |
| 5,318,321 | 6/1994 | Dogat et al. | 280/634 |
| 5,338,053 | 8/1994 | Haughlin | 280/615 |
| 5,354,088 | 10/1994 | Vetter et al. | 280/618 |
| 5,364,118 | 11/1994 | Burger et al. | 280/615 |
| 5,499,838 | 3/1996 | Hauglin et al. | 280/615 |
| 5,520,406 | 5/1996 | Anderson et al. | 280/624 |
| 5,558,355 | 9/1996 | Henry | 280/624 |

STEP-IN BINDING HAVING SAFETY RELEASE MECHANISM FOR TELEMARK SKI

FIELD OF THE INVENTION

This invention relates generally to the ski binding art and specifically to ski bindings intended for use in Telemark skiing. More specifically, the invention relates to a 75 mm Nordic Norm Telemark ski binding utilizing a step-in securing mechanism and a variable resistance safety release mechanism which automatically resets the step-in mechanism after the safety release mechanism is activated.

BACKGROUND OF THE INVENTION

To many skiers, the most important feature in a ski binding is its safety release mechanisms. Safety bindings for alpine skiing, which comprises a toe piece working in conjunction with a heel piece to hold a ski boot in place, are well known in the art. The safety release mechanisms in such bindings release the ski boot from the binding on impact. This feature is highly desirable as it avoids or lessens the chance of serious injury to the skier in the event of an emergency.

Telemark skiers, however, do not enjoy most of the safety mechanisms available to Alpine skiers. The reason is, in Telemark skiing, the rear portion or heel of the ski boot must be freely liftable, while the front portion or toe of the ski boot is secured to the binding. Without a heel piece to hold the ski boot, many of the safety mechanisms devised for the Alpine ski bindings cannot be implemented. In some early embodiments of the 75 mm Nordic Norm equipments, which are still used for Telemarking, safety release mechanisms are not provided at all.

In recent years, manually operated toe clamping bindings have become popular among Telemark skiers. In some of these bindings, a pivoting toe holding device is used in conjunction with a release plate, creating a safety mechanism. In the event of an emergency or an impact, the pivoting toe holding device remains attached to the ski boot but detaches from the ski to protect the skier from serious injuries. The toe holding device, however, remains attached to the ski boot. Heel tightening cable bindings can also employ a pivoting toe holding device in conjunction with a release plate. In the event of an emergency or an impact, the pivoting toe holding device and cable assembly remain attached to the ski boot and detach from the release plate. The problem with these two types of prior art bindings is that they require the skier to reattach the toe holding device to the release plate. This is oftentimes a cumbersome task, especially when the skier is facing inclement weather, extreme temperatures or hazardous terrains, where it is difficult or dangerous for the skier to use their hands to effect binding entry.

What is needed is a step-in auto-releasing binding for a 75 mm Nordic Norm ski boot which, following actuation of its safety release mechanism and release of the ski boot, returns automatically to a desired position for receiving the boot.

SUMMARY OF INVENTION

A step-in binding for telemark ski having safety release mechanism comprises a mounting plate, a housing, a clamp lever and a step-in lever. In accordance with the preferred embodiment, step-in securing is initiated by applying pressure to a step-in lever, which is coupled to cause a clamp lever to rotate downwardly to hold a front portion of a ski boot. A cam device coupled to the levers enables the clamp lever to hold the ski boot tightly. The tightening effect exerted by the clamp lever is locked in at a desired clamp tension by a latching means. The latching means is disengaged by rotating the housing assembly about a pivot post. With the latching means disengaged, the clamp lever becomes free to release the ski boot. The binding also comprises adjustable means for resisting the housing from rotation and means for resetting the binding to a position ready to receive the ski boot once the latching means is disengaged.

In an alternate embodiment of the present invention, the binding comprises a mounting plate, a housing, a step-in lever, a clamp lever, and a cable cam assembly. The cable cam assembly comprises a cable for pulling the heel portion of the ski boot firmly to the binding, and a cable cam for generating a tension when the step-in lever is depressed.

DESCRIPTION OF PREFERRED EMBODIMENT

Figure 1:
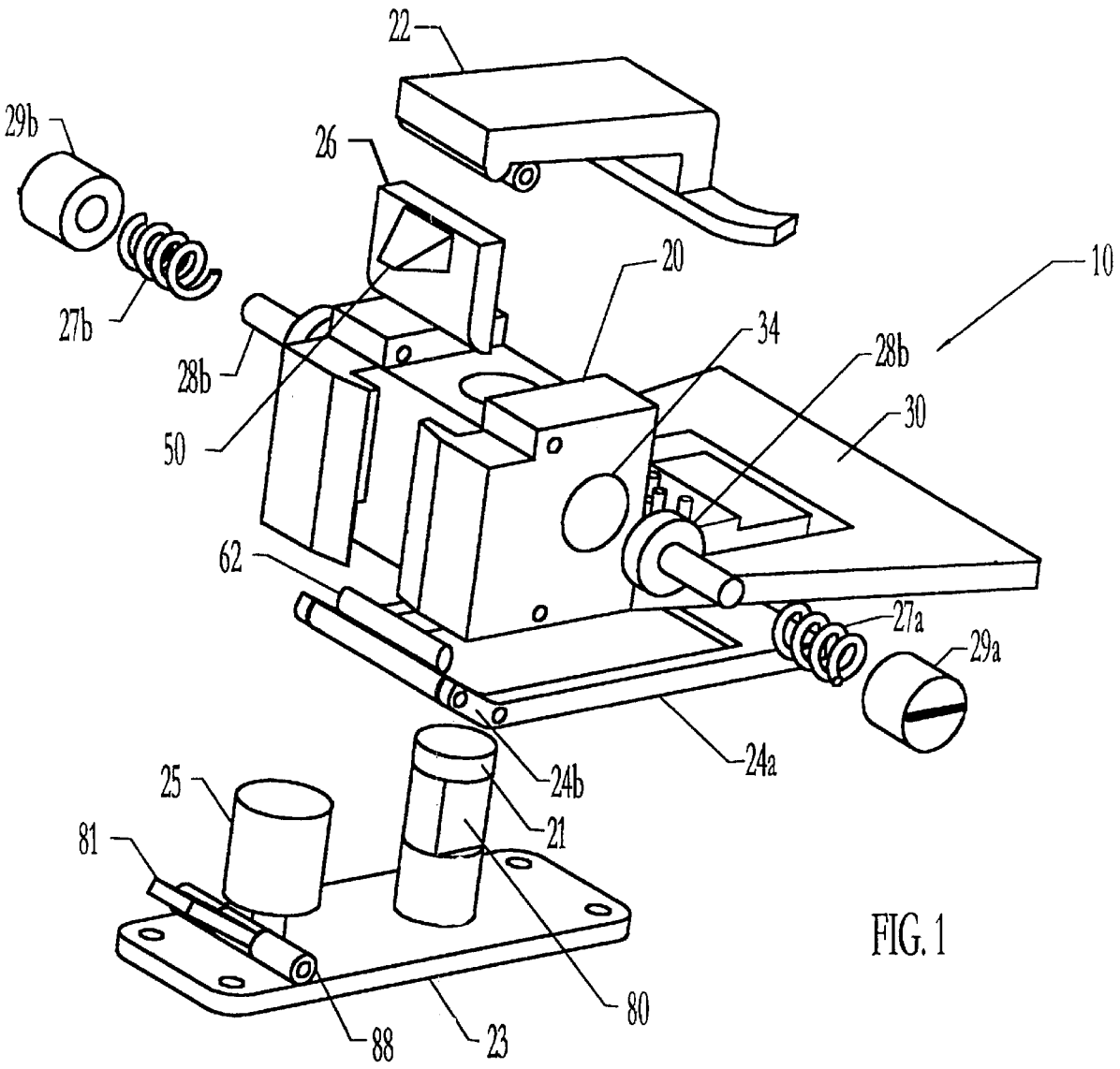
FIG. 1 illustrates an exploded perspective view of the preferred embodiment.

Referring now to the drawings, FIG. 1 illustrates an exploded perspective view of a binding 10 according to the preferred embodiment. The binding 10 includes a mounting plate 23 for mounting on a ski (not shown), and a housing 20 for coupling to the mounting plate 23. A step-in lever 24 and a clamp lever 22 are pivotably coupled to the housing 20. The step-in lever 24 comprises a first arm 24*a* and a second arm 24*b* which angulate at a fulcrum. When the binding 10 is not in use, the first arm 24*a* is positioned to be depressed by a ski boot (not shown). When the binding 10 is in use, the first arm 24*a* recesses flatly with a base plate 30. A cam 62 is coupled to the second arm 24*b* of the step-in lever for lifting a key 26 when the first arm 24*a* is depressed. The key 26 is in turn coupled to a clamp lever 22 such that, when the step-in lever 24 is depressed, the clamp lever 22 rotates downwardly towards the base plate 30. Due to the configuration the cam 62 and the key 26, the clamp lever 22 is rotated a larger degree than is the step-in lever 24. The added angular displacement of the clamp lever 22 causes a tightening effect on the ski boot when mounted on the binding 10. According to the preferred embodiment, there is a 17° angular displacement to allow the user to insert the toe of the ski boot when the binding is not engaged but hold the ski boot firmly while engaged.

As shown in FIG. 1, a pivot post 21 is inserted into the housing 20 such that the housing 20 is rotatably mounted to the mounting plate 23. Pistons 28*a* and 28*b* are inserted into the housing 20 through piston ports 34 to engage a pivot post 21. The pistons 28*a* and 28*b* are forced against the pivot post 21 with compression springs 27*a* and 27*b*, and set with tensioning screws 29*a* and 29*b*. In the preferred embodiment, the springs 27*a* and 27*b* forces the piston 28*a* and 28*b* against piston contact surfaces 80 on the pivot post 21. When the pistons 28*a* and 28*b* are pushed against the piston contact surfaces 80, the spring tension secures the housing 20 to the pivot post 21, and resists the housing 20 from rotating. The stiffness of the springs 27*a* and 27*b* can be adjusted with the screws 29*a* and 29*b*. The stiffer the springs 27*a* and 27*b*, the more difficult it is for the housing 20 to rotate.

A catching post 25 mounted on the base plate 23 is positioned to engage a tooth 50 of the key 26 when the tooth 50 is lifted above the catching post 25. The catching post 25 is coupled to a spring loaded hinge 88, which pushes the catching post 25 against the tooth 50. Once the catching post 25 engages the tooth 50, the clamp lever 22 will remain engaged until a release mechanism kicks in to disengage the tooth 50 from the catching post 25. The clamp lever can also be disengaged by manually depressing a release lever 81.

Figure 2:
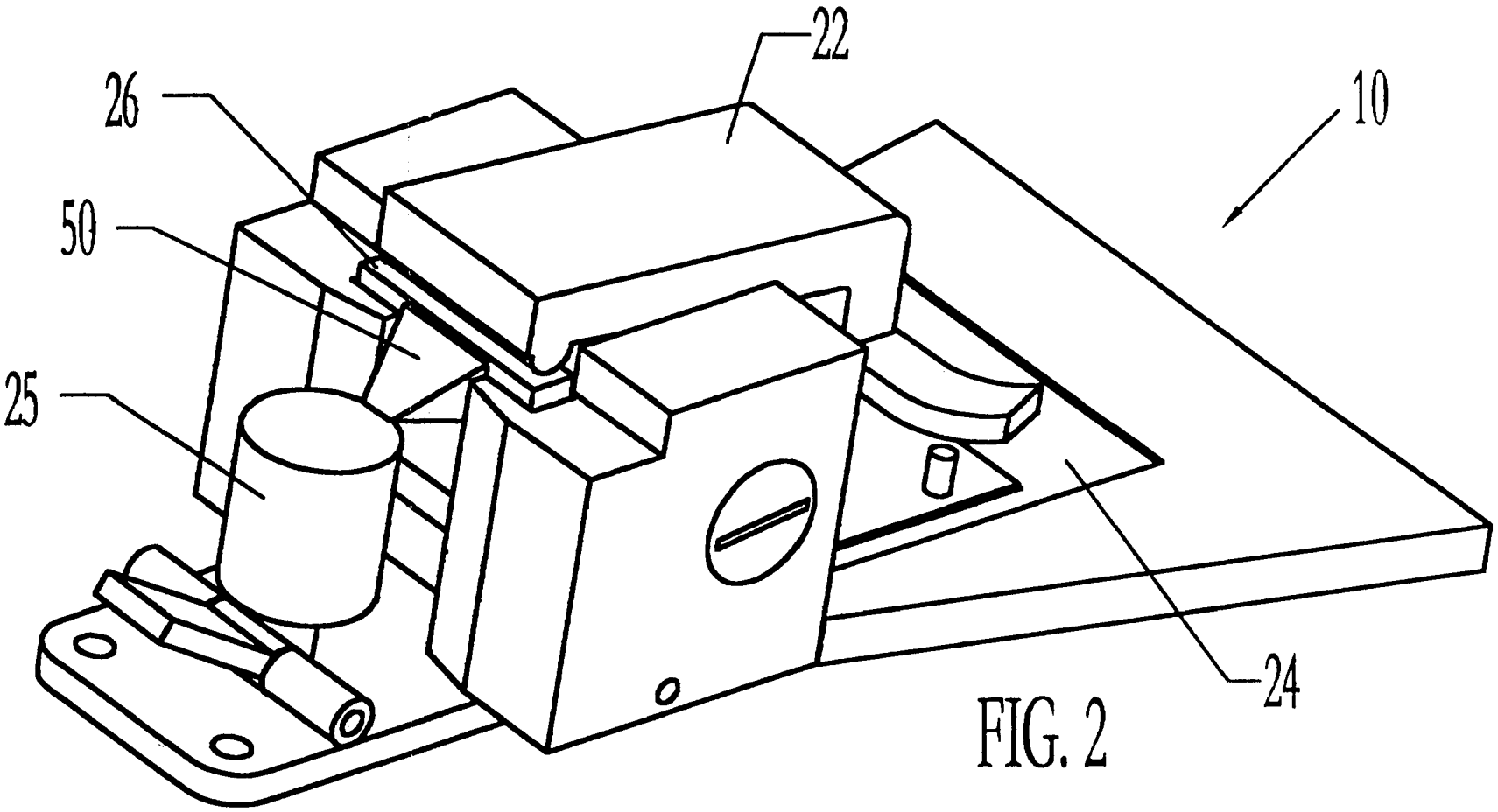
FIG. 2 illustrates a perspective view of the preferred embodiment of the present invention in an engaged position.

FIG. 2 illustrates a perspective view of the preferred embodiment of the present invention in an engaged position. The numberings of identical components in FIGS. 2–16 are the same as those of FIG. 1. As shown in FIG. 2, the key 26 locks the clamp lever 22 in an engaged position by latching the tooth 50 to the catching post 25.

Figure 3:
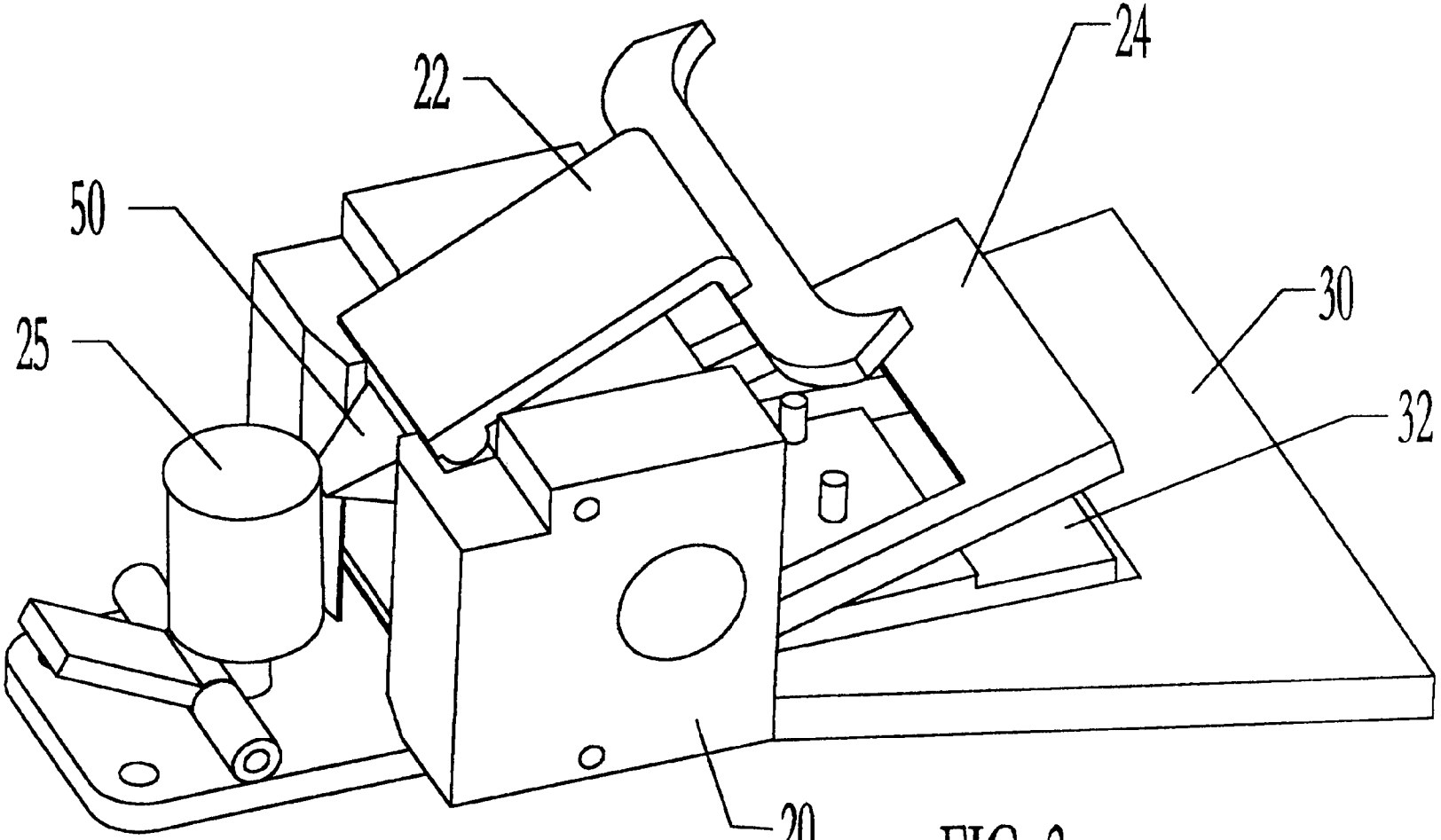
FIG. 3 illustrates a perspective view of the preferred embodiment of the present invention in a disengaged position.

FIG. 3 illustrates a perspective view of the preferred embodiment of the present invention in a disengaged position. According to FIG. 3, the tooth 50 is disengaged from the catching post 25. Without the tooth 50 latching to the catching post 25, the key 26 is lowered, causing the clamp lever 22 to pivot upwardly away from the base plate 30. It should be noted, in this disengaged position, the step-in lever 24 is elevated from the lever channel 32, and is in a position to be depressed by a ski boot.

Figure 4:
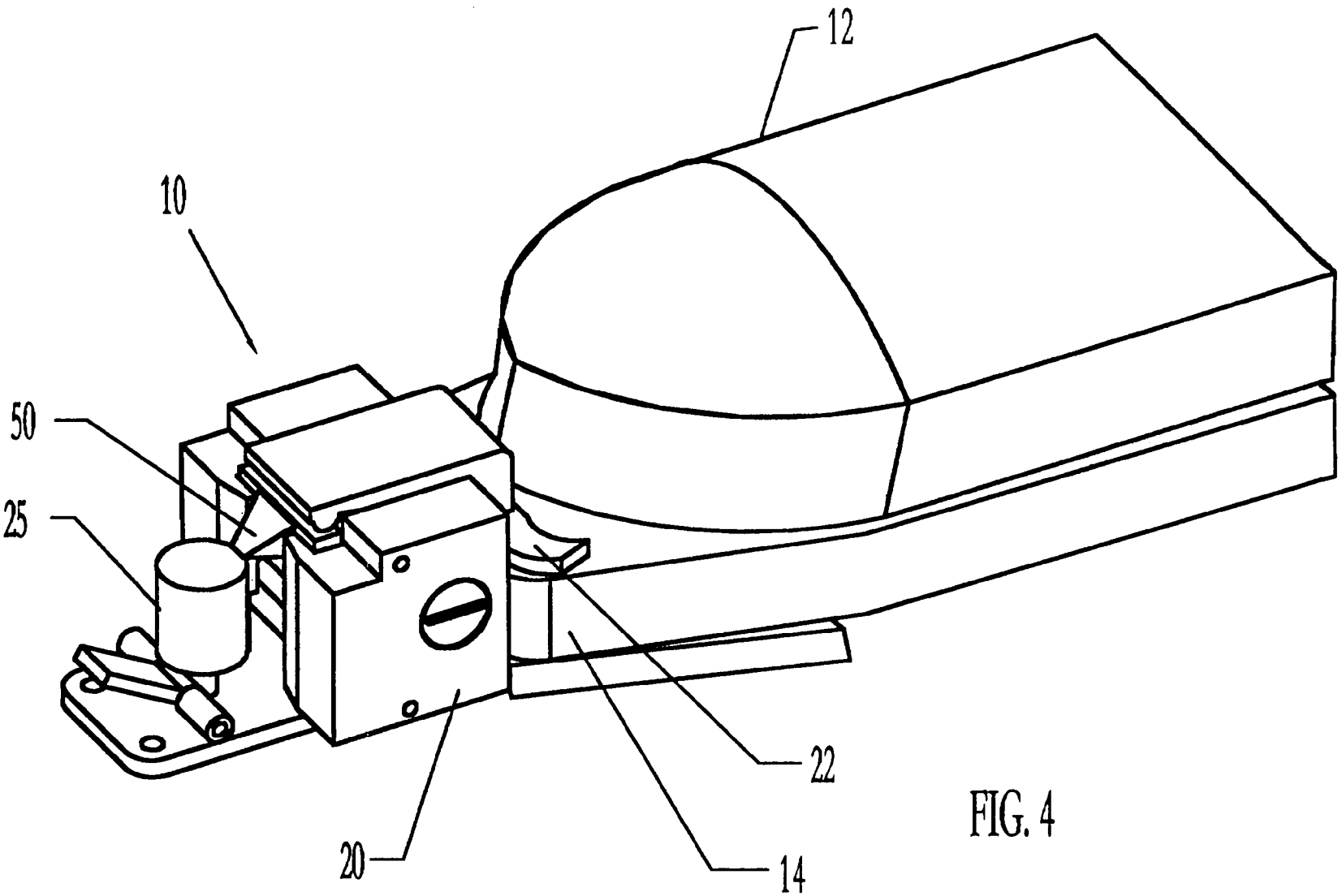
FIG. 4 illustrates a schematic view of 75 mm Nordic norm ski boot mounted on a binding according to the preferred embodiment of the present invention.

FIG. 4 illustrates a schematic view of a 75 mm Nordic norm ski boot 12 mounted on a binding 10 according to the preferred embodiment of the present invention. As shown in FIG. 4, a front portion or toe 14 of the sole of the 75 mm Nordic norm boot 12 is secured and held down by the clamp lever 22. FIG. 4 also illustrates that the tooth 50 is engaged to the catching post 25. Because the catching post 25 and the tooth 50 are engaged, the clamp lever 22 is locked in a position to firmly hold the toe 14 of the ski boot 12 to the binding 10.

Figure 5:
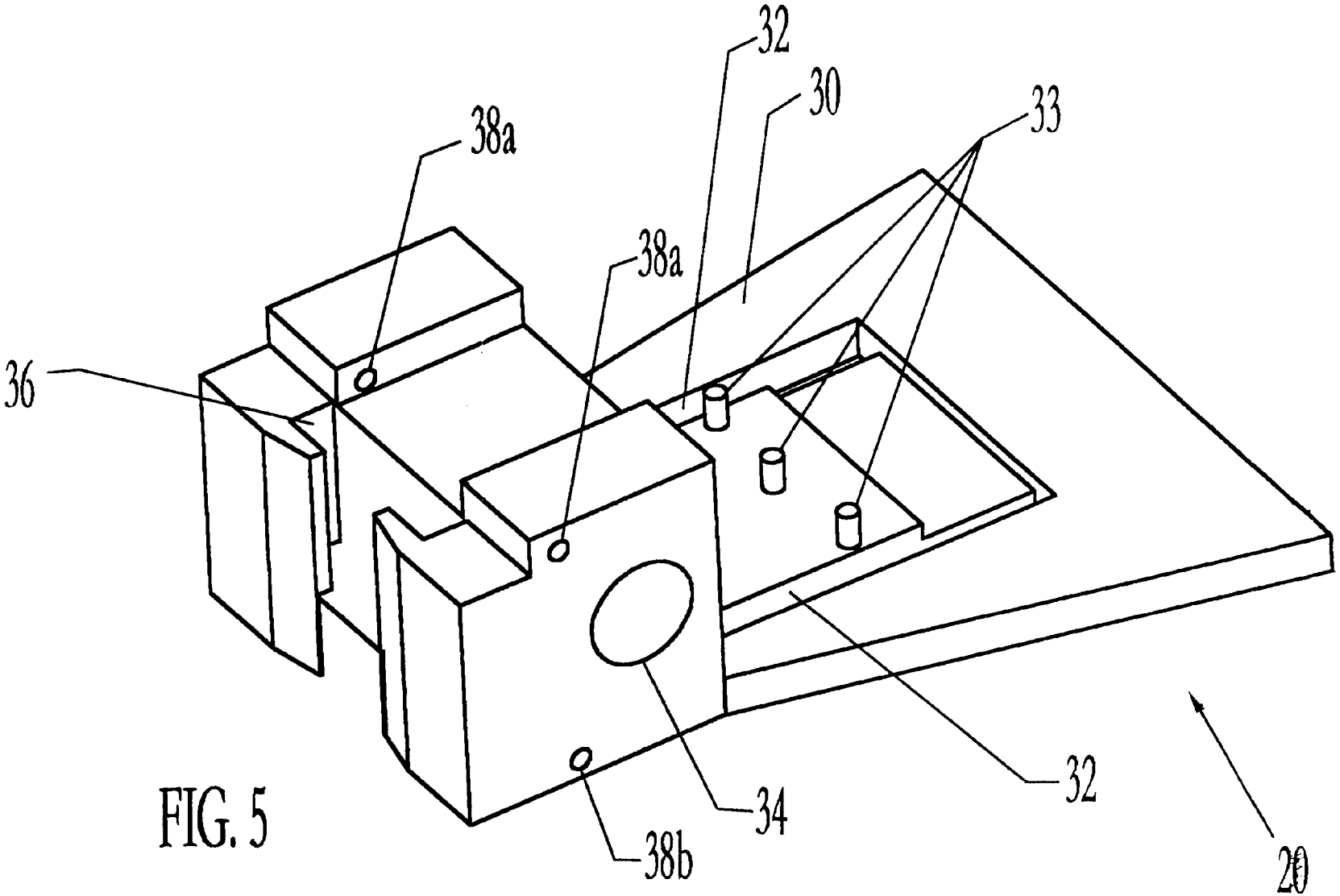
FIG. 5 illustrates a perspective view of a housing according to the preferred embodiment.

FIG. 5 illustrates the housing 20 according to the preferred embodiment. Included in this housing is an industry standard, 75 mm Nordic 3-pin norm base plate 30. The pins 33, characteristic of 75 mm Nordic Norm base plate, are also illustrated in FIG. 5. Lever channels 32 are cut in the plate 30 to allow the step-in lever 24 to recess flatly with the base plate 30 when the step-in lever 24 is depressed. A piston port 34 is provided on each side of the housing 20 for each of the pistons 28*a* and 28*b* (FIG. 1) to engage the pivot post 21 inserted from the bottom of the housing 20. A key channel 36 is provided in the housing to facilitate translation of the key 26 (FIG. 1). Lever bearing ports 38*a* and 38*b* for the step-in lever 24 (FIG. 1) and the clamp lever 22 (FIG. 1), respectively, are also illustrated in this figure.

Figure 6:
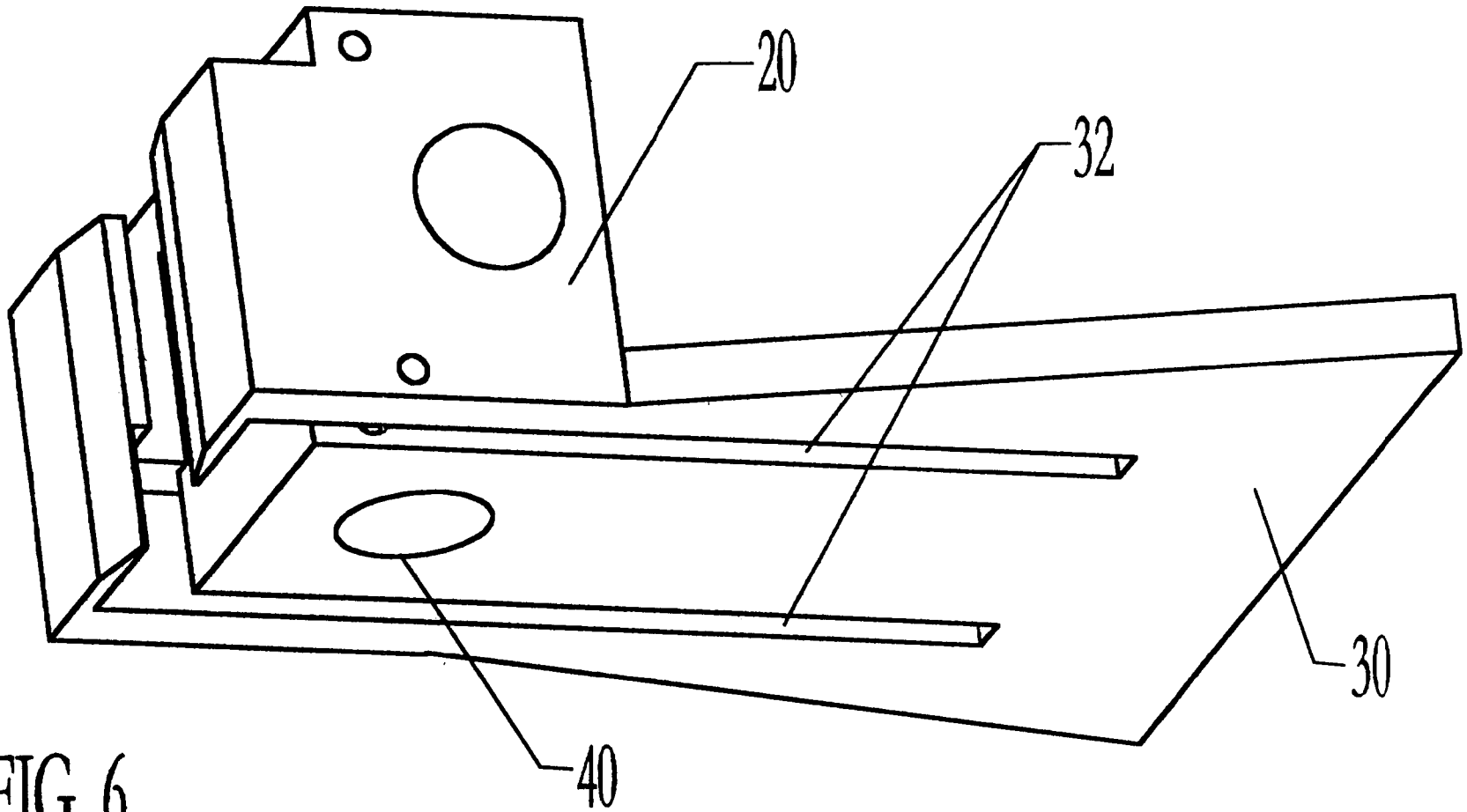
FIG. 6 illustrates a bottom isometric perspective view of a housing according to the preferred embodiment.

FIG. 6 illustrates a bottom isometric perspective view of the housing 20 of preferred embodiment. As shown in FIG. 6, the housing 20 includes a pivot post port 40 for accepting the pivot post 21 (FIG. 1). The pivot post 21 is inserted into the housing 20 through the pivot post port 40 and is held within the housing 20 by the pistons 28*a* and 28*b* (FIG. 1).

Figure 7:
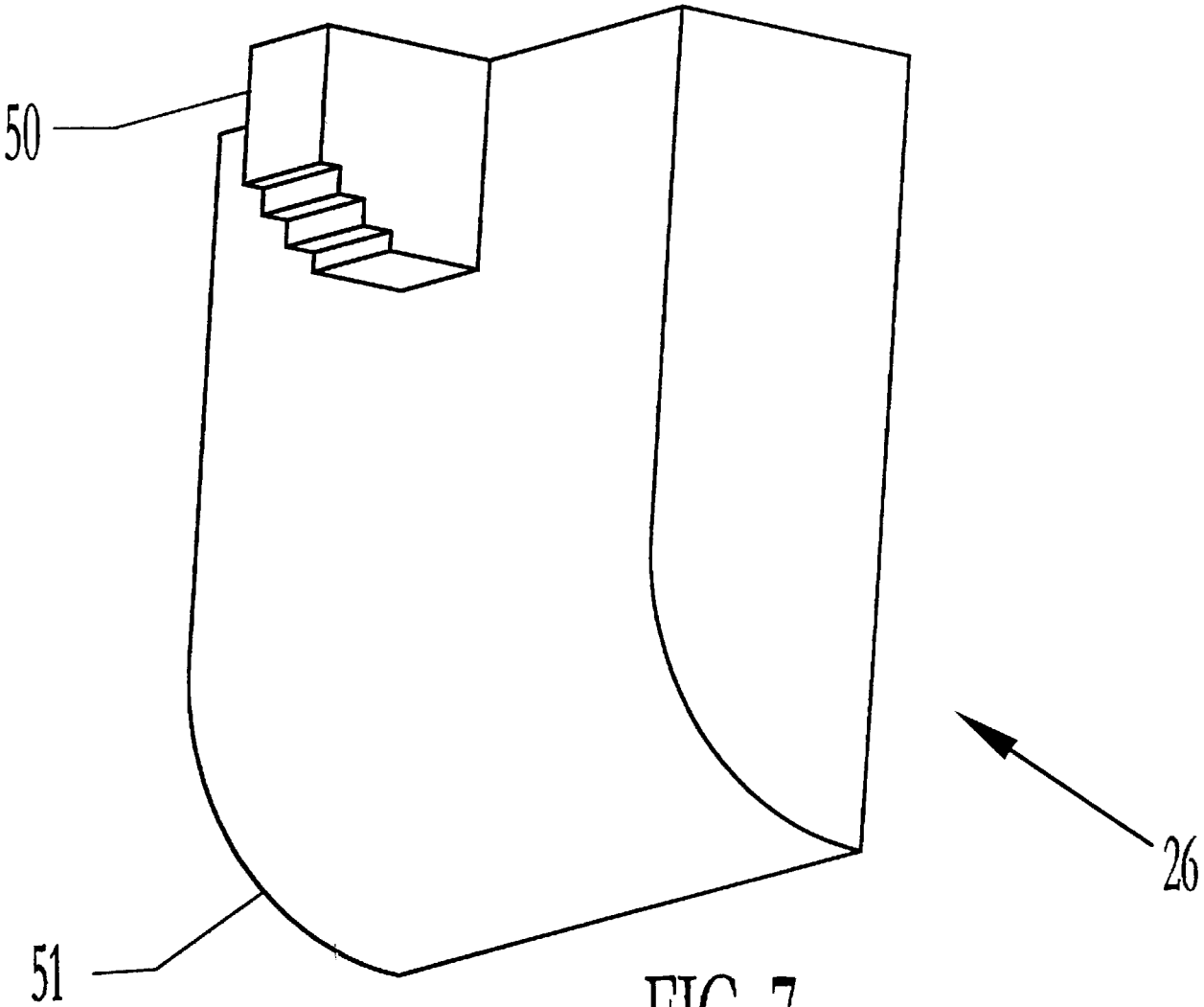
FIG. 7 illustrates perspective view of a key according to the preferred embodiment.

FIG. 7 illustrates the key 26 according to the preferred embodiment. Protruding from a face of the key 26 is a tooth 50 which acts as a latch member when it rises to engage the top surface of the catching post 25 (FIG. 1). The tooth 50 has a ratcheted lower surface for engaging the catching post 25. The ratcheted lower surface of the tooth 50 and the catching post 25 are configured to operate as a ratchet-and-pawl such that the key 26 can be raised in small increments. A curved surface 51 at the base of the key 26 optimizes a displacement of the key 26 by the cam 62 (FIG. 1). It will be apparent that other shapes of keys and teeth can be utilized to achieve the function of the invention.

Figure 8:
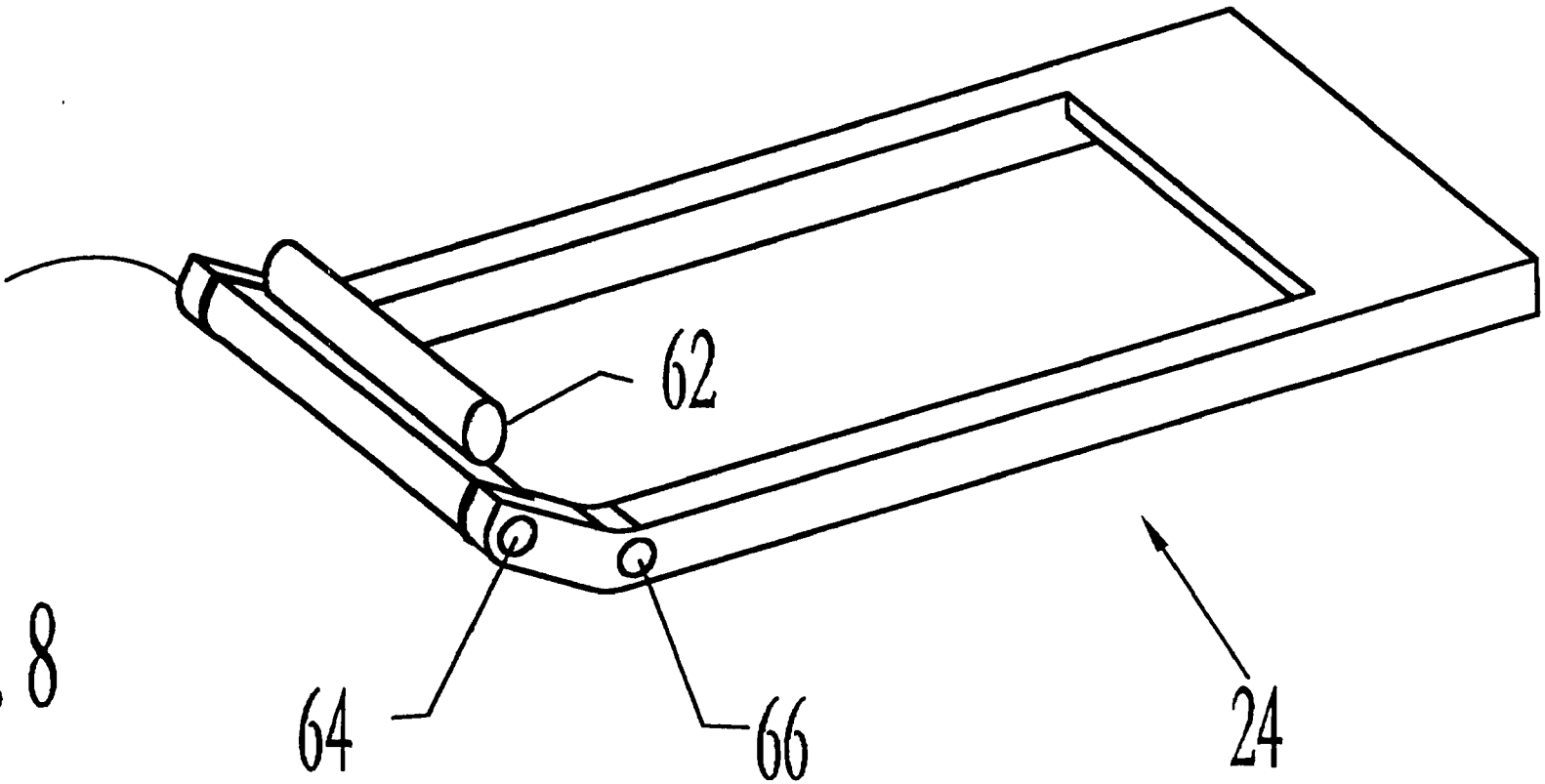
FIG. 8 illustrates a perspective view of a step-in lever in accordance with the preferred embodiment.

FIG. 8 illustrates a step-in lever 24 where a cam 62 is coupled to the step-in lever 24 at a cam end 64. The cam 62 engages the curved surface 51 (FIG. 7) of the key 26 (FIG. 7) to optimize displacement of the key 26 (FIG. 7). In the preferred embodiment, the cam 62 has an elliptical cross-section. Race holes 66 are made in the step-in lever 24 to match the lever bearing ports 38*b* (FIG. 5). In the preferred embodiment, an axle (not shown) is inserted through the race holes 66 and the bearing ports 38*b* of the housing to act as a fulcrum for the step-in lever 24.

Figure 9:
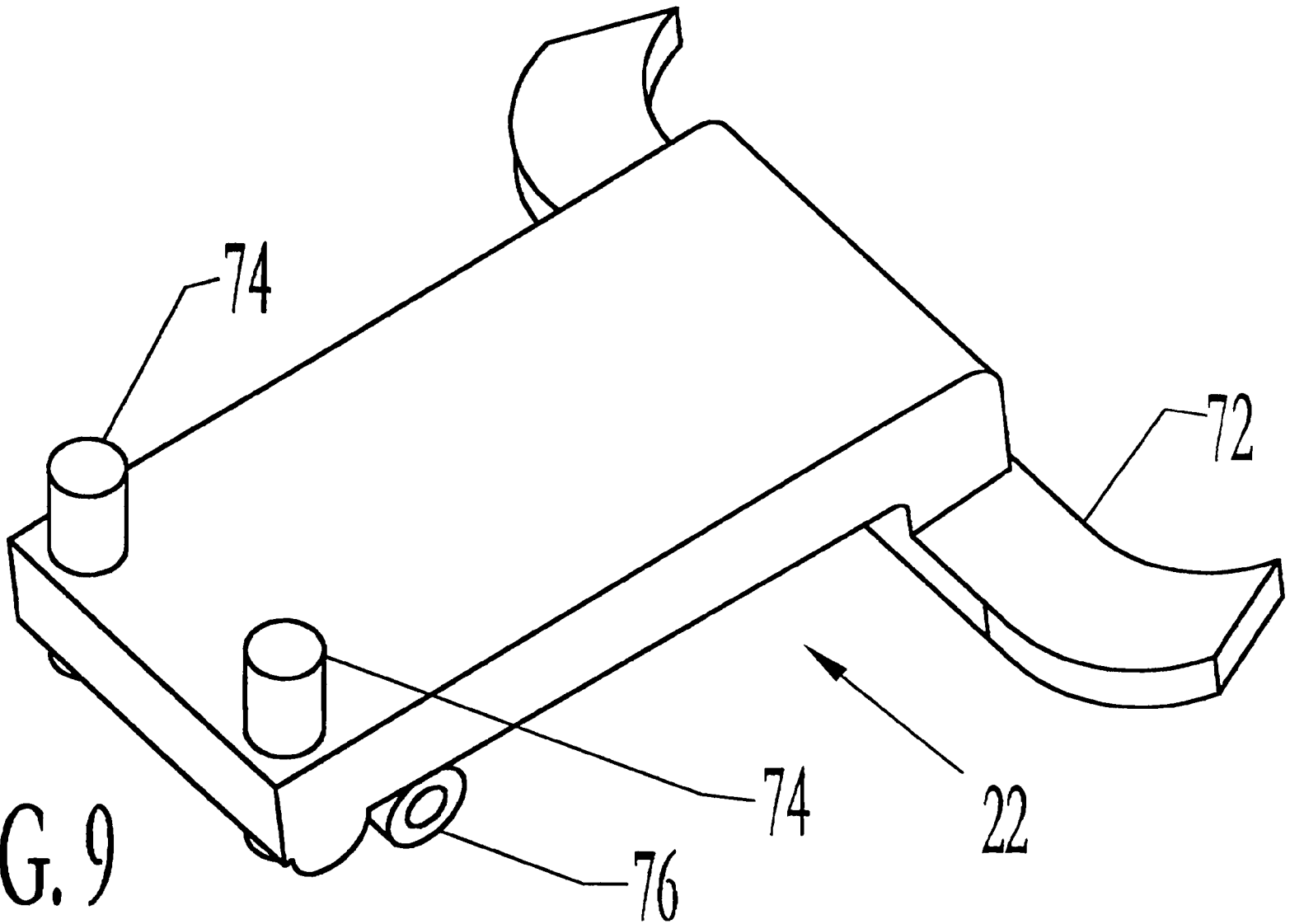
FIG. 9 illustrates a perspective view of a clamp lever in accordance with the preferred embodiment.

The clamp lever 22 of the preferred embodiment is depicted in FIG. 9. As shown in the figure, the clamp lever 22 comprises a toe clamp 72 for securing a ski boot (not shown) to the binding 10 (FIG. 1). Adjustment screws 74 are coupled to the clamp lever 22 for adjusting the distance between the key 26 (FIG. 1) and the clamp lever 22. When the distance between the key 26 and the clamp lever 22 is adjusted, different boot thicknesses can be accommodated. A clamp lever race 76 is attached to the clamp lever 22. The clamp lever race 76 matches the bearing ports 38*a* (FIG. 5) such that an axle (not shown) can be inserted through the clamp lever race 76 and the bearing ports 38*a* (FIG. 3) and that the axle can act as a fulcrum for the clamp lever 22.

Figure 10:
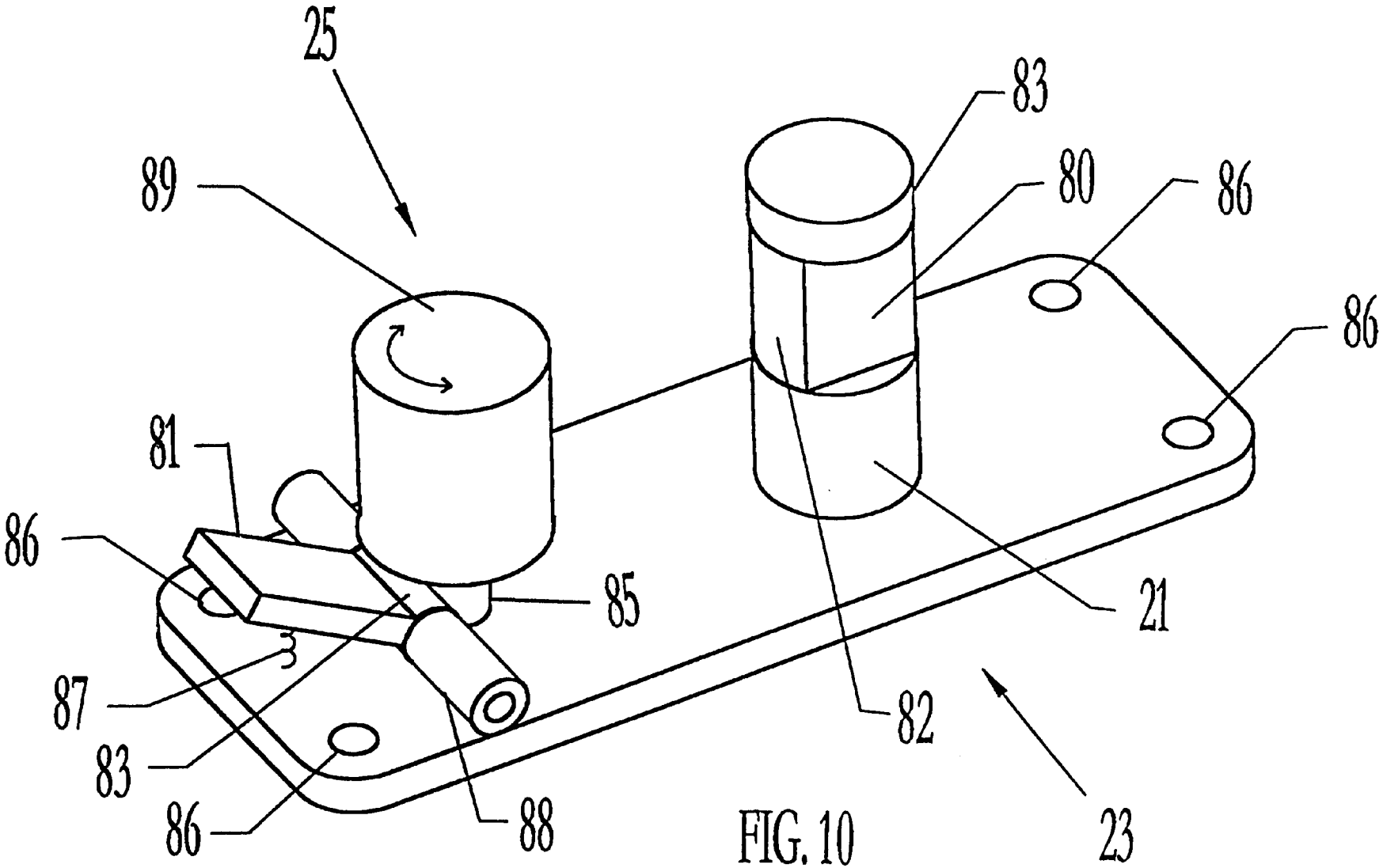
FIG. 10 illustrates a perspective view of a mounting plate of the preferred embodiment.

FIG. 10 illustrates a mounting plate 23 of the preferred embodiment. The pivot post 21 has two substantially flat piston contact surfaces 80 cut into the wall of the pivot post 21. These piston contact surfaces 80 are diametrically opposed to one another on the outer surface of the pivot post 21. When the housing 20 is in a non-rotated position, the pistons 28*a* and 28*b* (FIG. 1) engages the piston contact surfaces 80. A removal restricting channel 82 encircles the cylinder wall at a height equal to the flat piston contact surfaces 80 for retaining the pivot post 21 in the housing 20 below a circular ridge 83 surrounding the top of the pivot post. The mounting plate 23 further comprises ski mounting holes 86 for securing the mounting plate 23 to the ski surface (not shown). The housing 20 is pivoted about the pivot post 21 when rotational forces exerted on the housing 20 or the mounting plate 23 overcomes the forces required to compress the springs 27*a* and 27*b*. Rotating the mounting plate 23 relative to the housing 20 causes the pistons 28*a* and 28*b* to translate from the flat pivot post surfaces 80 to the round pivot post channel surface 82, thus compressing the springs 27*a* and 27*b* (FIG. 1). When the rotational forces are no longer exerted on the ski, the springs 27*a* and 27*b* will cause the pistons 28*a* and 28*b* to rotate to re-engage the flat surfaces 80 and reset the binding 10 to the non-rotated position.

As shown in FIG. 10, the catching post 25 is attached to the mounting plate 23 surface by a catching hinge bearing 88. A release lever 81 is attached to a catching hinge 83, along with the catching post base 85. The release lever 81 is for the user to intentionally release the bindings. When the release lever 81 is depressed, the catching post 25 will disengage the tooth 50 (not shown) to release the ski boot. The catching hinge 83 and the catching post 25 are forced towards the pivot pin 21 (FIG. 2) by a catching hinge spring 87. An adjustment cap 89 raises and lowers as it is rotated around the catching post base 85. By rotating the adjustment cap 89, the height of the catching post 25 can be adjusted.

Figure 11:
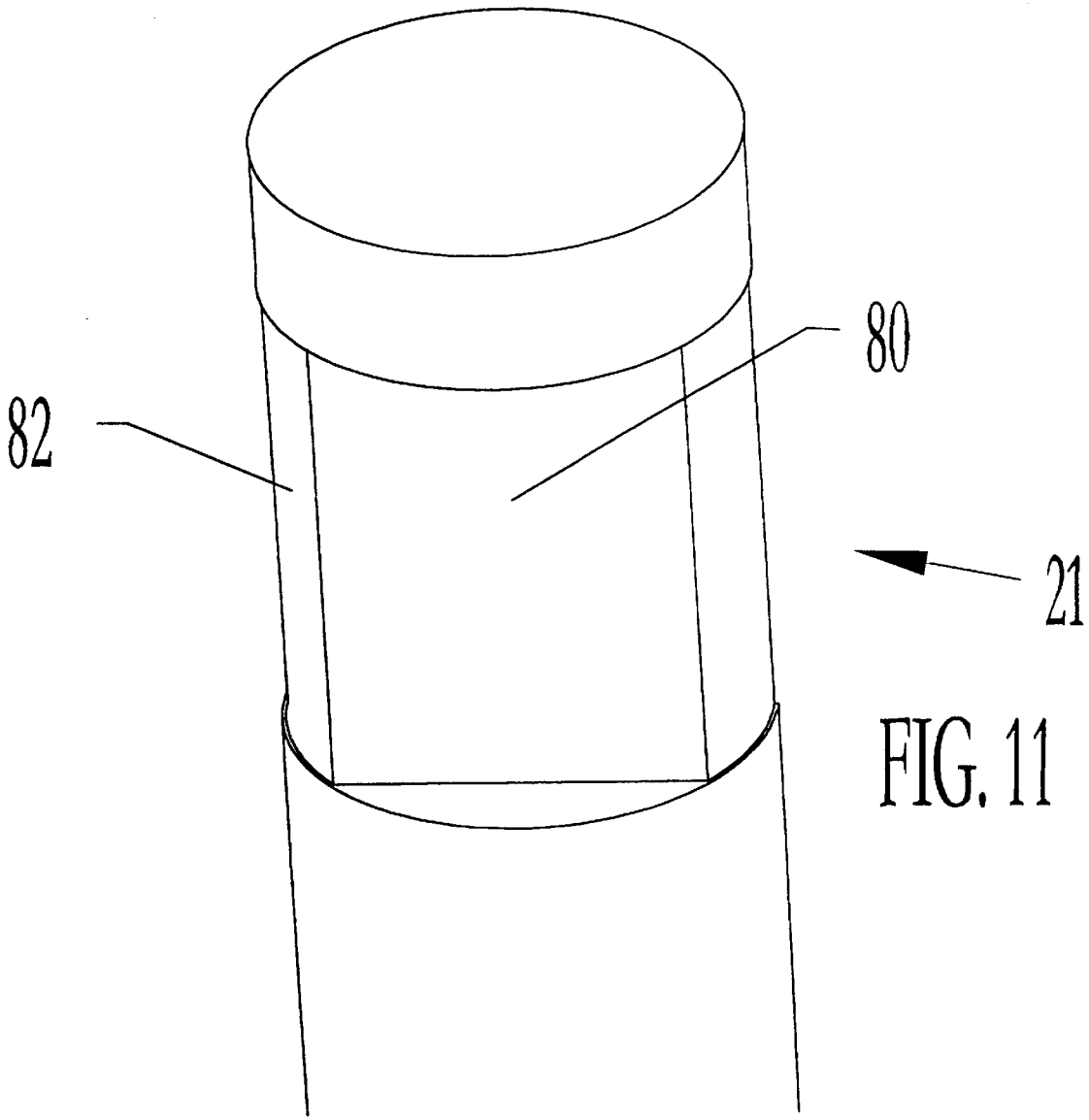
FIG. 11 illustrates an enlarged perspective view of a pivot post of the preferred embodiment.

FIG. 11 illustrates an enlarged view of the pivot post 21 which shows the removal restricting channel 82 clearly. In the preferred embodiment, the removal restricting channel 82 is slightly depressed into the wall of the pivot post 21. When the housing 20 is rotated, the pistons 28*a* and 28*b* engage the removal restriction channel 82. Because the removal restriction channel 82 is depressed into the wall of the pivot post 21, the circular ridge 83 will be able to stop the pistons 28*a* and 28*b* from moving in a vertical direction relative to the mouting plate 23 even if the pistons 28*a* and 28*b* are disengaged from the piston contact surfaces 80.

Figure 12:
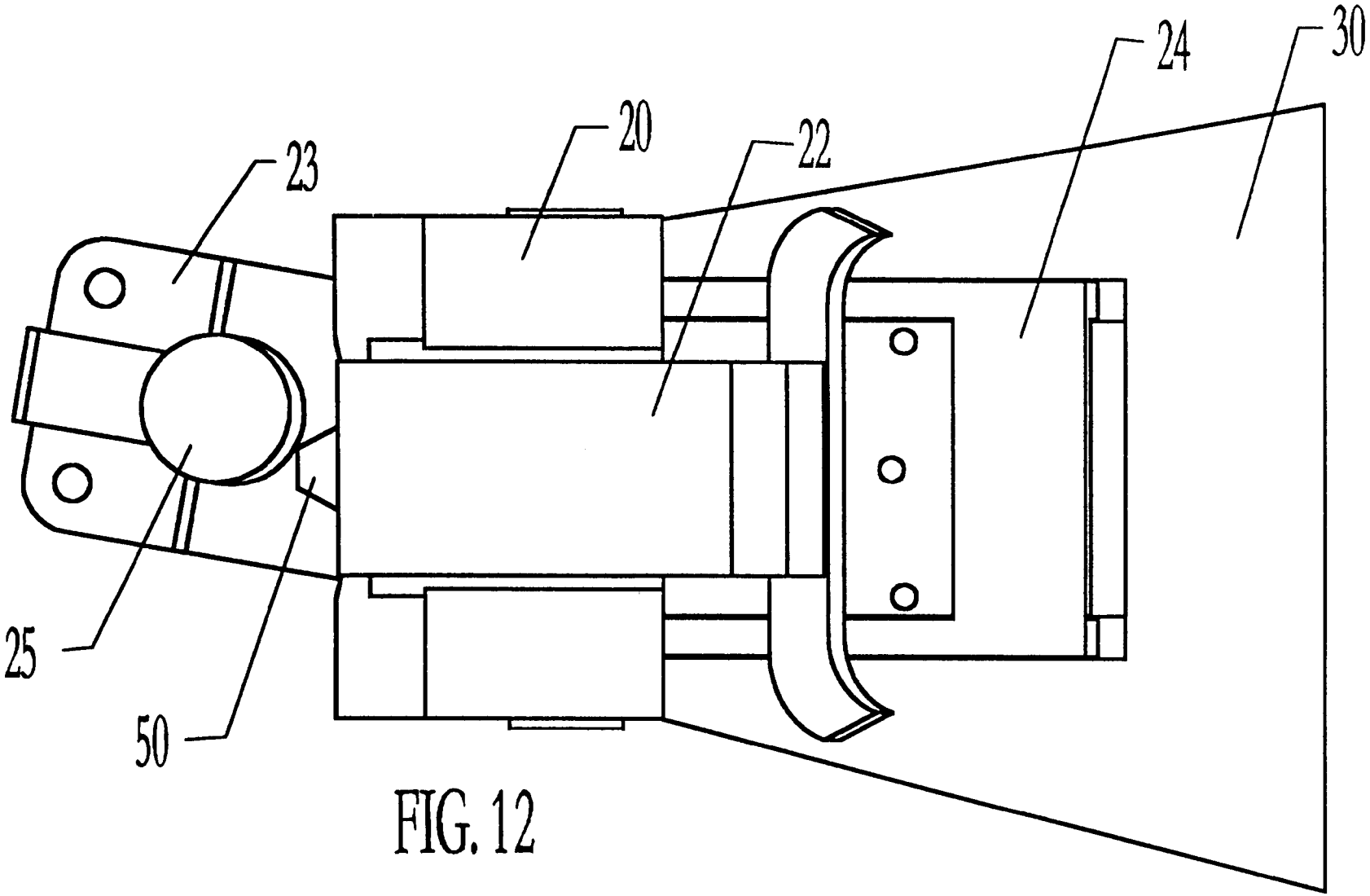
FIG. 12 illustrates a binding according to the preferred embodiment in a rotated position.
Figure 13:
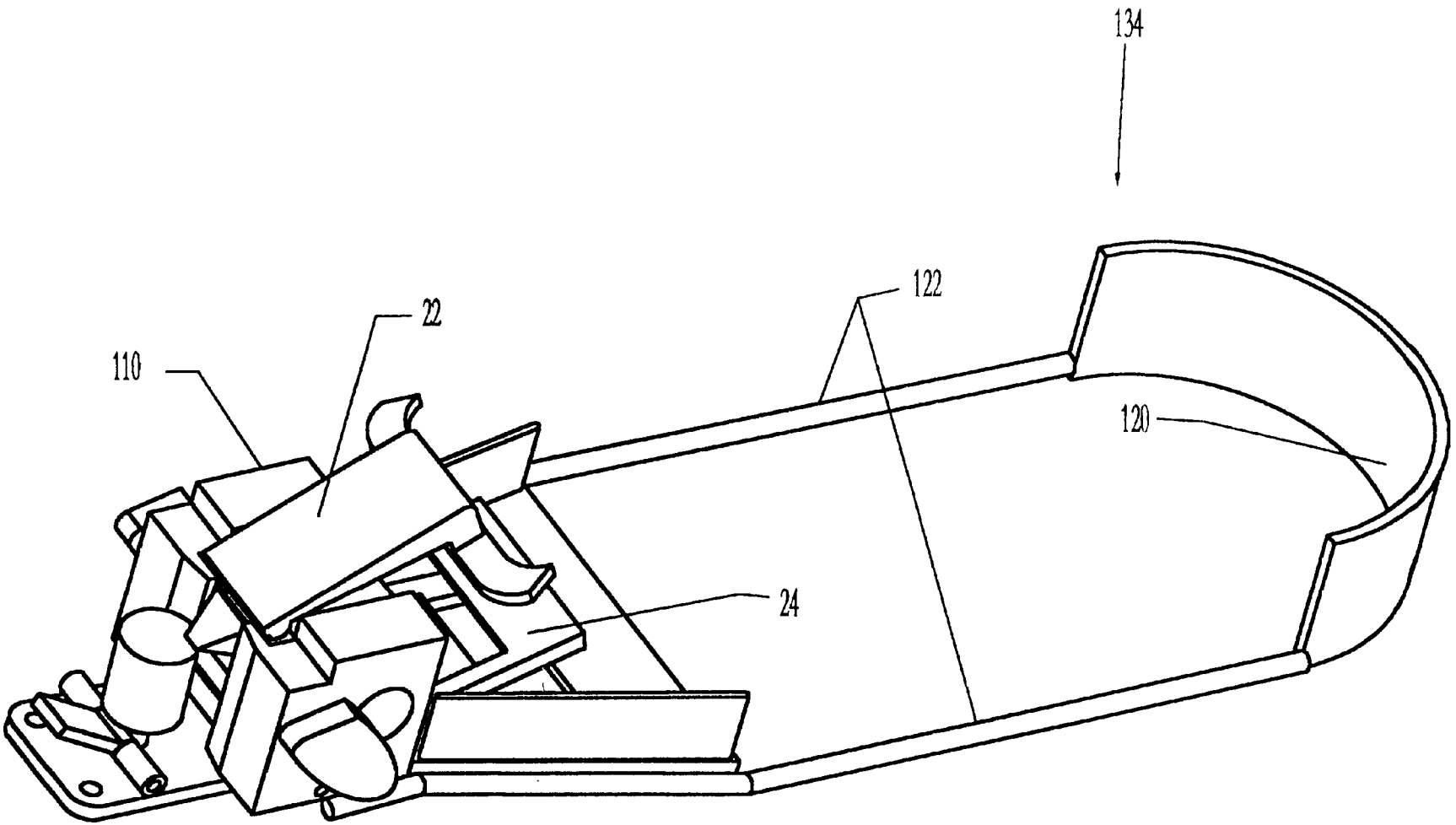
FIG. 13 illustrates a perspective view of an alternate embodiment of the present invention.

FIG. 12 illustrates the binding 10 of the preferred embodiment when the housing 20 is rotated about the pivot post 21. According to FIG. 12, the tooth 50 disengages from the catching post 25, leaving the key 26 (FIG. 1) unsupported. Without the key 26 latched to the catching post 26, the clamp lever 22 will be free to open, which allows the ski boot to freely leave the ski.

Figure 14:
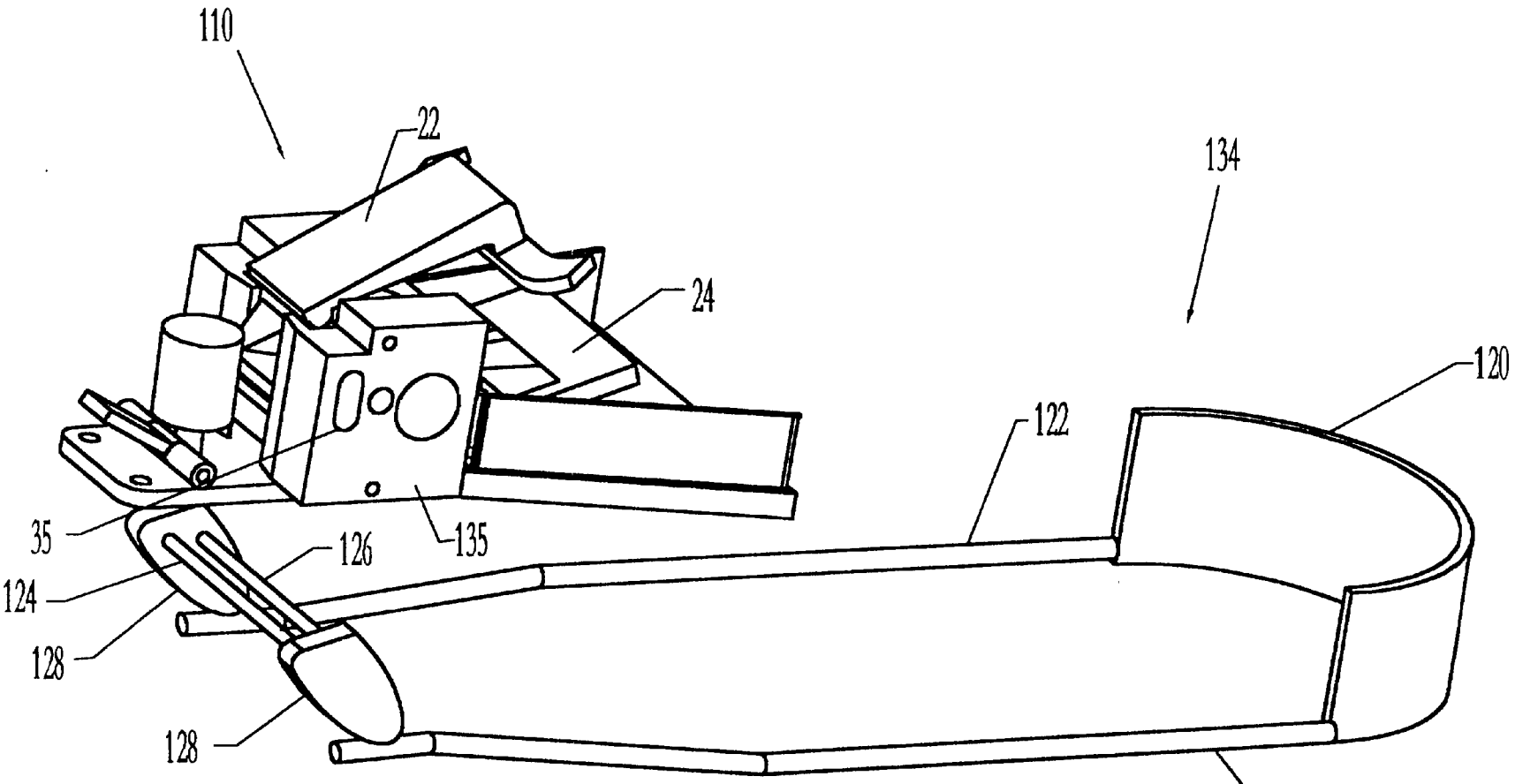
FIG. 14 illustrates an exploded view of a cable cam assembly according to the alternate embodiment of the present invention.
Figure 15:
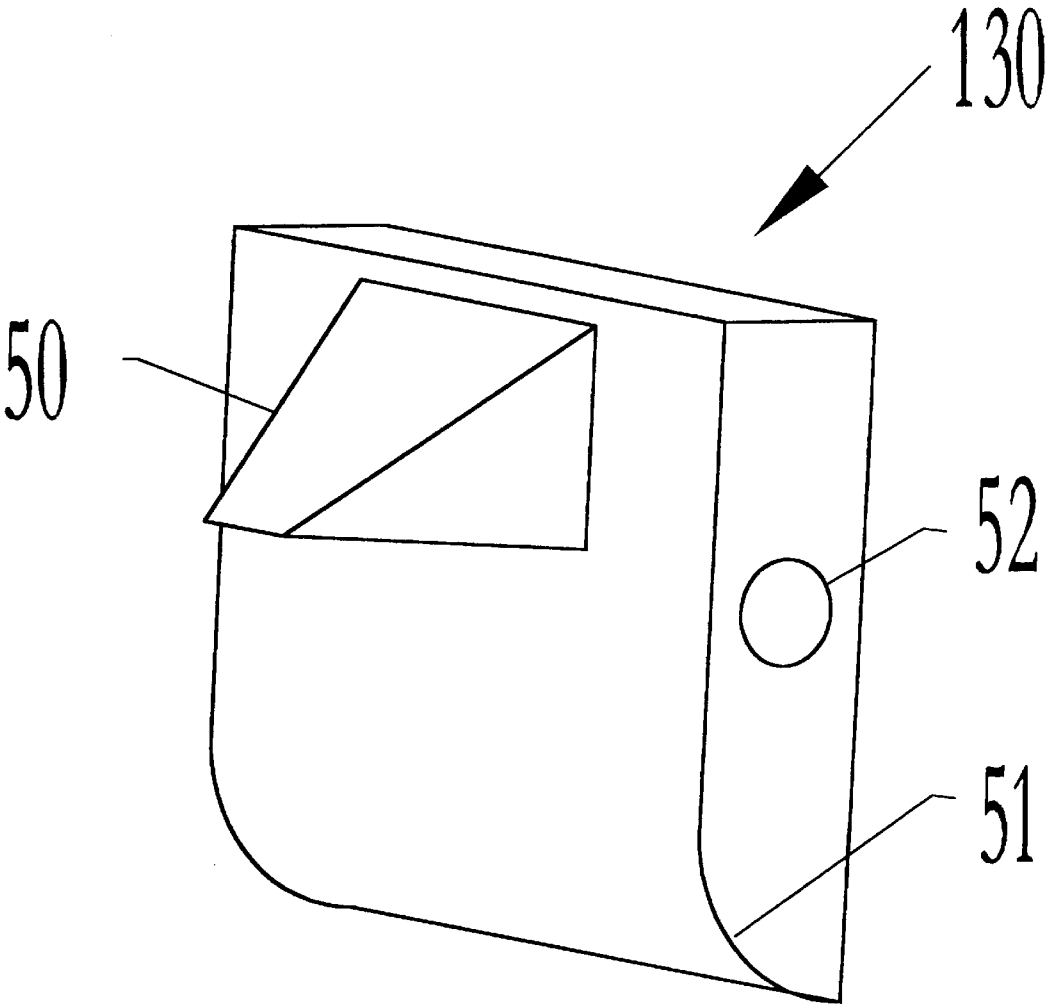
FIG. 15 illustrates a perspective view of a key according to the alternate embodiment of the present invention.
Figure 16:
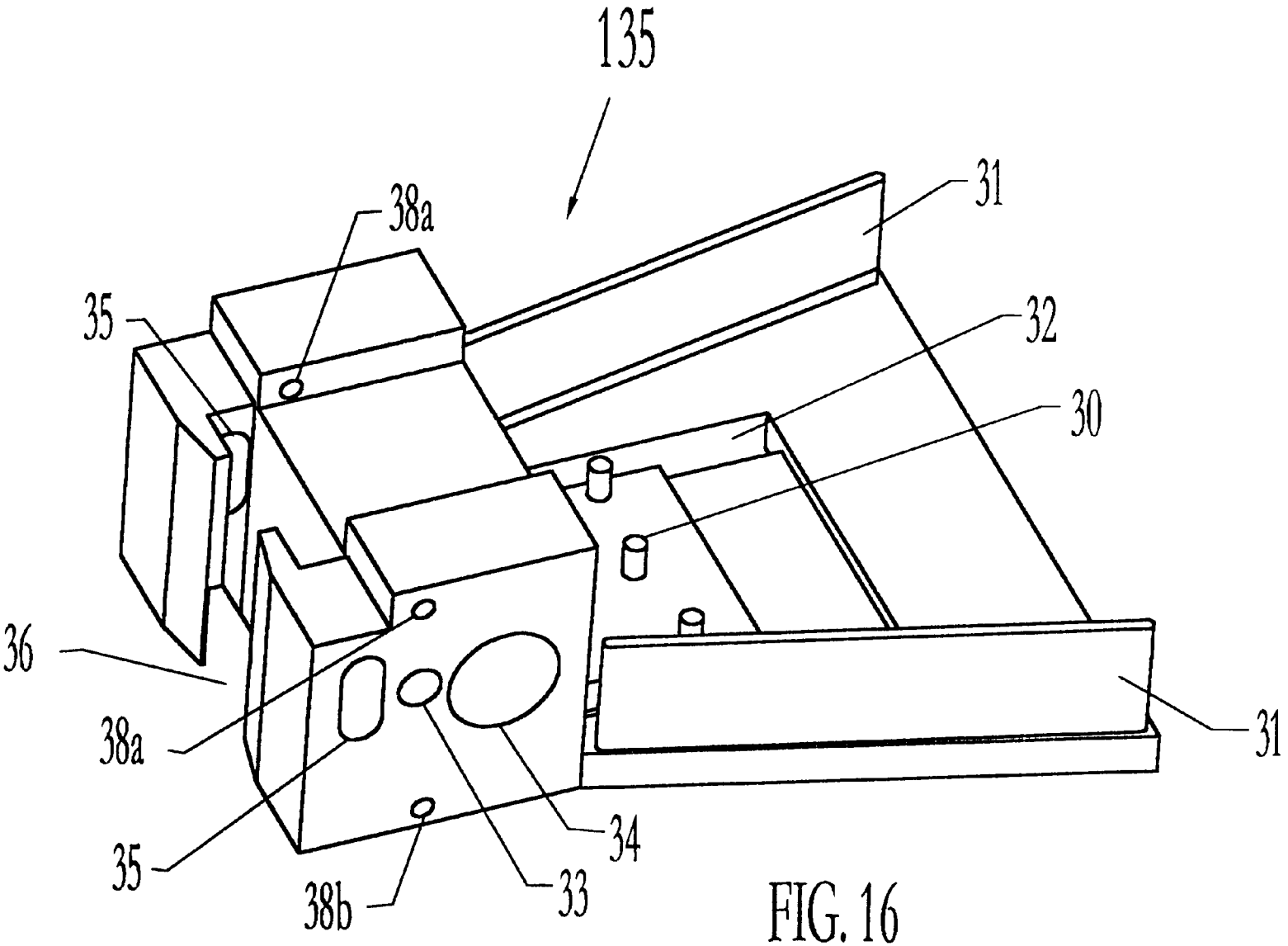
FIG. 16 illustrates a perspective view of a housing according to the alternate embodiment of the present invention.

FIGS. 13, 14, 15, and 16 illustrate an alternate embodiment of the present invention. In this embodiment, the binding 10 includes a mounting plate 23 (FIG. 10), a housing 135 (FIG. 16), a step-in lever 24 (FIG. 8), a clamp lever 22 (FIG. 9), and a cable assembly 134 (FIG. 14). The step-in lever 24 and the clamp lever 22 securely holds the toe 14 of a ski boot 12 in exactly the same manner as in the preferred embodiment. In this embodiment, the effectiveness of the clamp lever 22 is enhanced by the cable assembly 134 which firmly pulls a heel of the ski boot 12 (not shown) to the binding 10. Tension is created when the step-in lever 24 is depressed and a key 130 (FIG. 15) is raised. A key axle 124 (FIG. 14) is inserted through key axle slots 35 (FIG. 14) and through a key axle hole 52 (FIG. 15). The key axle 124 is raised by the step-in lever 24 together with the key 130. A cable cam 128 (FIG. 14) is attached to the ends of a cam rotation axle 126 and the key axle 124. As the key 130 raises the key axle 124, the cable cam 128 rotate about the cam rotation axle 126. Attached to the cable cams 128 are the ends of the cable assemblies 122. As the cable cam 128 rotates, the cable assembly 122 pulls heel engaging means 120 towards the front of the binding 10, thus tightening around the boot heel and securing the boot to the binding. When sufficient tension is reached, a tooth 50 of the key 130 engages the variable height catching post 25. This embodiment, however, is not the best mode or the preferred mode of the present invention because the added complexity necessarily increases the manufacturing cost of the binding.

Figure 17:
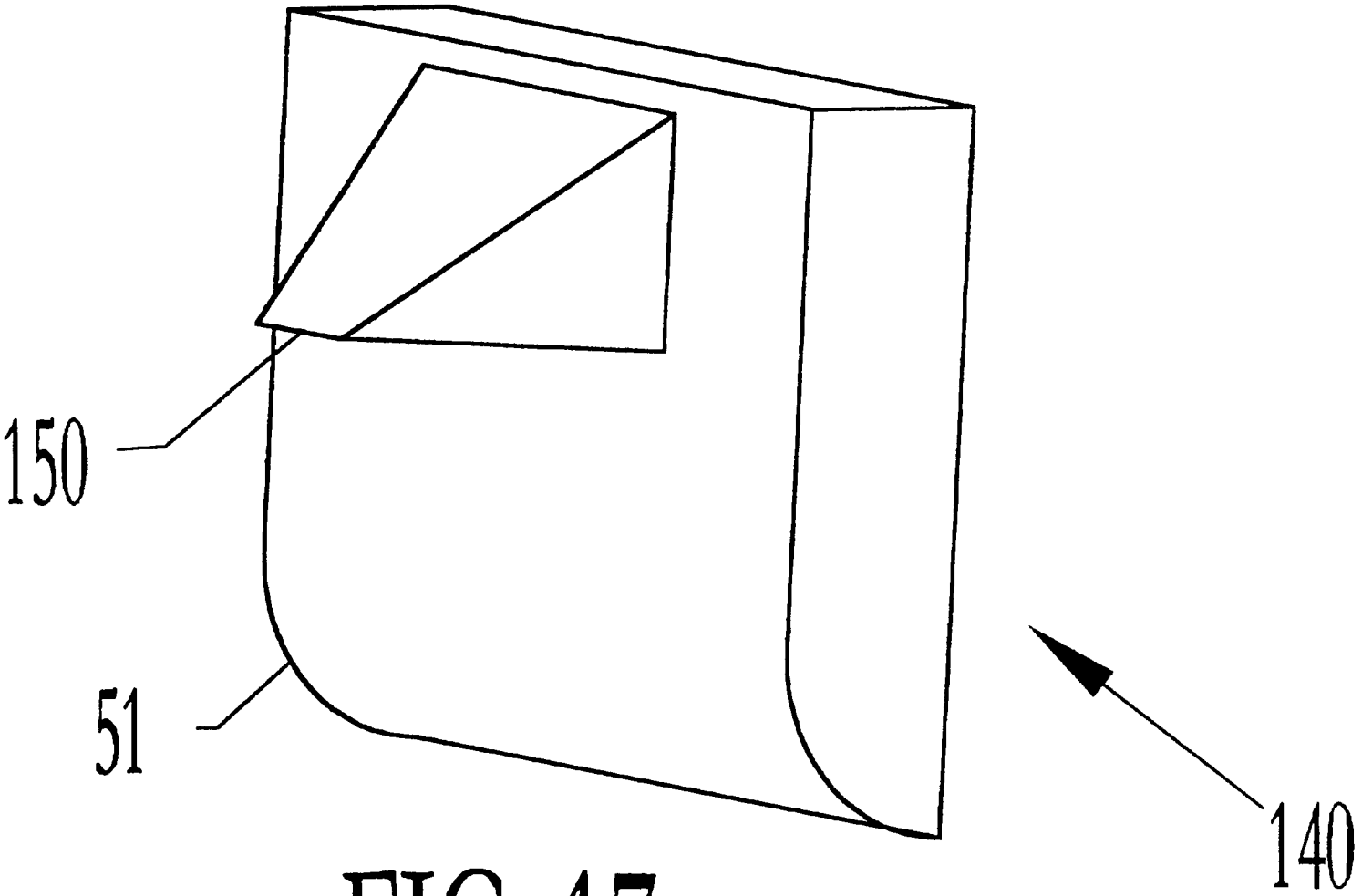
FIG. 17 illustrates a perspective view of a key according to a second alternate embodiment of the present invention.

FIG. 17 illustrates a key 140 according to yet another embodiment of the present invention. In this alternate embodiment, the key 140 is substituted for the key 26 (FIG. 7). As shown in FIG. 17, the key 140 comprises a tooth 150 which protudes from a surface of the key 140. The tooth 150 is wedge shaped for pushing off the catching post 25 as the tooth 150 is being lifted. Although the tooth 150 does not serve the purpose of ratcheting, in this alternate embodiment the tooth 150 does latch the key 140 to the catching post 25.

The present invention provides for Telemark skiers using 75 mm Nordic Norm easily accessible means for effecting boot/binding entry. This object is met by providing a step-in securing mechanism. This mechanism eliminates the need to use ski pole tips or bare or gloved hands in binding entry. Further, the present invention provides a safety mechanism for automatically releasing the ski boot in the event of an emergency. This invention is useful for Telemark racers, whose high speeds warrant a safety binding. Additionally, the present invention is ideal for beginning telemark skiers, who fall with greater frequency than more experienced skiers, and skiers who have previously suffered injury and wish to lessen the chance of further injury while Telemark skiing.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention. Specifically, it will be apparent to one of ordinary skill in the art that the present invention could be practiced in many different ways and the apparatus disclosed above is only illustrative of the preferred embodiment of the present invention.

What is claimed is:

1. A step-in binding detachably mounting a ski boot on a ski, comprising:

a) a base configured to be coupled to the ski;

b) a first toe lever pivotably mounted to the base for mount between a release position and a locked position and configured to pivot relative to the base and to hold a toe portion of the ski boot in locking engagement against the base while in the locked position;

c) a lever actuator coupled to the first toe lever, the lever actuator being operable when the toe portion of the ski boot is positioned therebetween and is pressed downwardly upon the lever actuator for causing the first toe lever to pivot downwardly into locking engagement with the toe portion of the ski boot; and d) engaging members mounted on the base and engageable with the toe portion of the ski boot for retaining the ski boot between the first toe lever and the lever actuator during locking engagement of the first toe lever with the toe portion of the ski boot; wherein the toe portion of the ski boot is fixedly mounted to the base in the locked position while a rear portion of the ski boot is free to lift away from the ski.

2. The binding according to claim 1 further comprising a mounting plate coupled to the ski, wherein the base is coupled to the ski by mounting the base to the mounting plate.

3. The binding according to claim 1 wherein the lever actuator is a second lever positioned to be depressed by the ski boot when the ski boot is mounted to the base.

4. The binding according to claim 3 further comprising a cam mounted to the base to be driven by the second lever for driving the first toe lever such that a distance between the first toe lever and the second lever while non-engaged is larger than while engaged.

5. The binding according to claim 3 further comprising a latching means coupled to the lever actuator for locking the first toe lever and the second lever when engaged.

6. The binding according to claim 5 wherein the latching means comprises a catching post and a key driven by the cam for engaging the catching post.

7. The binding according to claim 5 further comprising means for automatically disengaging the latching means.

8. The binding according to claim 7 wherein the means for disengaging the latching means is configured to release the catching post when the ski boot rotates relative to the base.

9. The binding according to claim 1 further comprising means for resisting the ski boot from rotating relative to the base.

10. The binding according to claim 1 further comprising means for automatically resetting the binding to a position ready to receive the ski boot after the ski boot is disengaged by an external force.

11. The binding according to claim 1 wherein the binding is configured for accepting a telemark ski boot.

12. A step-in auto-releasing binding for attaching a ski boot to a ski, comprising:

a. a mounting plate for mounting to the ski, wherein the mounting plate includes a latch engaging means and a main post;

b. a housing coupled to the mounting plate for receiving the ski boot, wherein the housing is rotatable about the main post;

c. a first lever pivotably mounted on the housing and configured for pivoting downwardly toward the mounting plate to engage the ski boot to the housing, wherein a front portion of the ski boot is fixedly mounted to the base while a rear portion of the ski boot is free to lift away from the ski;

d. a cam configured to cause the first lever to pivot downwardly toward the mounting plate when the cam is lifted; and e. a second lever pivotably mounted to the housing and coupled to lift the cam, wherein the second lever is positioned to be depressed by the ski boot when the ski boot is engaged to the housing.

13. The binding according to claim 12 wherein the cam is configured to cause the first lever to sweep a greater angle than the second lever, thus providing a tightening effect on the front portion of the ski boot.

14. The binding according to claim 12 further comprising a latching means coupled to the levers for locking the levers in an engaged position.

15. The binding according to claim 14 wherein the latching means comprises a catching post and a key driven by the cam for engaging the catching post, wherein the key disengages from the catching post when the housing is rotated to a predetermined release position.

16. The binding according to claim 15 wherein the key further comprises a tooth for engaging the key to the catching post, further wherein the tooth has a ratcheted surface for raising the key a limited amount each time the key is raised.

17. The binding according to claim 15 wherein the catching post is variable in height for accommodating ski boots having different sizes.

18. The binding according to claim 12 wherein the cam has an elliptical cross-section.

19. The binding according to claim 12 further comprising means coupled to the housing for resisting the housing from rotation and for resetting the housing to a neutral position after the housing is rotated, wherein the means for resisting and resetting comprises:

a. a piston for engaging a substantially flat surface of the main post when the housing is in the neutral position and for engaging a curved surface when the housing is rotated; and b. a compression spring coupled to the piston for pushing against the main post and for providing a resetting force.

20. The binding according to claim 12 wherein the mounting plate further comprises a three-bin plate configured for receiving a 75 mm Nordic Norm ski boot.

21. A step-in binding for attaching a nordic ski boot to a telemark ski, the binding having an ability to automatically release the ski boot when the binding is rotated, comprising:

a. a mounting plate for mounting to the telemark ski, wherein the mounting plate includes a pivot post;

b. a housing coupled to the mounting plate for receiving the ski boot, wherein the housing is rotatable about the pivot post;

c. a step-in lever pivotably coupled to the housing, wherein the step-in lever includes a first end for receiving a toe of the ski boot and a second end for lifting an elliptical cam when the first end is depressed;

d. a key coupled to the elliptical cam, wherein the key includes a tooth;

e. a catching post coupled to the mounting plate for latching to the key when the key is lifted by the elliptical cam to a predetermined position; and f. a toe clamp lever coupled to the housing, wherein the toe clamp lever includes a third end for coupling to the key and a fourth end for coupling to a toe clamp, wherein toe clamp securely holds the ski boot when the third end is raised by the key.

22. The binding according to claim 21 further comprising an adjustable means for resisting rotation of the housing and for resetting the housing to a neutral position after the housing is rotated, the means comprising:

a. a piston for engaging a substantially flat piston contact surface of the pivot post when the housing is in the neutral position, wherein the piston engages to a curved surface of the pivot post when the housing is in rotated;

b. a compression spring coupled to the piston for pushing against the pivot post; and c. a tensioning screw coupled to the compression spring for setting a stiffness of the spring.

23. The binding according to claim 21 wherein the housing releases the ski boot when the tooth disengages from the catching post.

24. The binding according to claim 21 wherein the tooth disengages from the catching post when the housing is rotated.

25. The binding according to claim 21 wherein the catching post comprises a spring-loaded hinge pivotably coupled to the mounting plate for forcing the catching post into the tooth.

26. The binding according to claim 21 wherein the mounting plate further comprises a three-pin plate configured for receiving a 75 mm Nordic Norm ski boot.

27. The binding according to claim 21 wherein the tooth has a ratcheted lower surface for engaging the catching post and for raising the key a limited amount each time the key is raised.

* * * * *

UNITED STATES PATENT AND TRADEMARK OFFICE

CERTIFICATE OF CORRECTION

PATENT NO. : 6,105,994

DATED : August 22, 2000

INVENTOR(S) : Parris et al.

It is certified that error appears in the above-identified patent and that said Letters Patent is hereby corrected as shown below:

In column 7, line 53, delete "claim 5" and insert --claim 6--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*